US005586678A

United States Patent [19]

Rosch et al.

[11] Patent Number: 5,586,678

[45] Date of Patent: Dec. 24, 1996

[54] BULK HOPPER TANK LID OPENER ASSEMBLY

[75] Inventors: Hans J. Rosch, Aurora; Steven R. Beck, Central City, both of Nebr.

[73] Assignee: TIC United Corp., Dallas, Tex.

[21] Appl. No.: 334,529

[22] Filed: Nov. 4, 1994

[51] Int. Cl.[6] ..... B65D 43/26

[52] U.S. Cl. ..... 220/263; 220/262; 220/331; 49/357; 52/194; 52/197

[58] Field of Search ..... 220/262, 263, 220/329, 331; 49/357, 383, 90.1; 52/192, 194, 197

[56] References Cited

U.S. PATENT DOCUMENTS

| | | | |
|---|---|---|---|
| 1,324,667 | 12/1919 | Hanson | 220/331 X |
| 1,461,253 | 7/1923 | Owen | 220/329 X |
| 2,195,033 | 3/1940 | Lehman | 220/331 X |
| 3,262,227 | 7/1966 | Pentecost | 220/331 X |
| 3,666,135 | 5/1972 | Kindle | 220/263 X |

*Primary Examiner*—Stephen Cronin
*Attorney, Agent, or Firm*—Stephen T. Belsheim

[57] ABSTRACT

A bulk hopper tank assembly which has a bulk hopper tank containing an opening at the top end thereof wherein a lid assembly selectively covers the opening. The lid assembly includes a lid, a generally vertical arm extending along the exterior side of the bulk hopper tank, and a generally horizontal arm connecting the lid and the vertical arm. A lifter connects to the vertical arm and is moveable between a down position in which the lid covers the opening in the bulk hopper tank and an up position in which the lid is vertically above the opening in the bulk hopper tank. A handle connects to the vertical arm and is moveable to a plurality of positions between a first position in which the lid is in the vertical volume of the opening and a second position in which the lid is outside of the vertical volume of the opening.

15 Claims, 2 Drawing Sheets

BULK HOPPER TANK LID OPENER ASSEMBLY

BACKGROUND OF THE INVENTION

The invention pertains to a bulk hopper tank having an opening in the top end thereof, and more specifically, to such a bulk hopper tank having a lid which selectively covers the opening. When the lid does not cover the opening it assumes a position away from the vertical cylinder above and defined by the opening so as to provide unimpeded access to the opening by the auger of a supply vehicle, such as, for example, a grain truck or the like.

Generally speaking, a bulk hopper tank receives particulate materials, such as, for example, grain, for storage and later distribution. The typical bulk hopper tank has a top opening and includes lid which selectively covers the opening. Typically, the height of a bulk hopper tank has been greater than that of an operator. While the operator can climb up a ladder and open the lid, this exposes the operator to the danger of falling off the bulk hopper tank. To eliminate this potential for injury, some bulk hopper tanks now have an arrangement whereby the operator remains on the ground and operates the lid to selectively open and close the opening.

In order to add material to the bulk hopper tank, the lid must be removed to expose the opening to outflow of the supply vehicle. In the case where the bulk hopper tank stores grain, the auger of a grain truck must have access to the opening. It is important that the lid is clear of the opening so that any part of the supply vehicle does not impinge thereupon so as to cause damage to the lid or the supply vehicle.

It can thus be appreciated that a bulk hopper tank in which the lid is operated from the ground in such a fashion so that it is clear of the opening to permit unimpeded access therethrough is a desirable objective. In the past, others have tried to provide a bulk hopper tank having a top opening wherein the lid is operated from the ground in an effort to be clear of the opening. The following United States patents disclose some systems which try to provide the above objectives; however, none of these patents provide a way to positively make certain that the lid is clear of the opening so as to provide unimpeded access therethrough.

U.S. Pat. No. 5,218,784 to Pollock shows a grain bin with a ground-operated apparatus to open and close the opening via a lid. The lid appears to pivot away from the opening so that while it may be somewhat clear of the opening, it is not completely clear thereof. As a consequence thereof, there remains the chance that the lid may interfere with access to the opening. U.S. Pat. No. 4,744,183 to Kruger also shows an arrangement whereby there is a ground-operated lid opener. This arrangement also provides from the pivoting of the lid away from the opening so that it may interfere with access to the opening. U.S. Pat. No. 4,625,888 to Thompson also shows a ground-operated assembly wherein the lid pivots away from the opening. Like with the other arrangements, there appears to be the potential for the lid to interfere with access to the opening. U.S. Pat. No. 4,598,496 to Van Daele, U.S. Pat. No. 4,327,522 to Meadows, and U.S. Pat. No. 4,267,936 to Pavlicek each show arrangements in which the lid pivots away from the opening such that it may still interfere with access thereto.

Even though there are bulk hopper tanks that try to address the problem of free access to the opening while permitting operation of the lid from the ground, they still suffer from the basic defect of not providing interference-free access.

SUMMARY OF THE INVENTION

It is an object of the invention to provide an improved bulk hopper tank which has an opening in the top thereof wherein the lid can be operated at the ground level.

It is another object of the invention to provide an improved bulk hopper tank which has an opening in the top thereof wherein the lid can be operated at the ground level so as to provide for interference free access to the tank through the opening.

In one form thereof the invention is a bulk hopper tank assembly which comprises a bulk hopper tank having a top end and a bottom end as well as an opening at the top end thereof. The assembly further includes a lid assembly which comprises a lid, and a generally vertical arm, which has top and bottom ends, extending along the exterior side of the bulk hopper tank, and a generally horizontal arm having opposite ends wherein one end thereof attaches to the lid and the other end thereof connects to the top end of the vertical arm. The assembly also has a lifter attached to the bottom end of the vertical arm. The lifter is moveable between a down position in which the lid covers the opening in the bulk hopper tank and an up position in which the lid is vertically above the opening in the bulk hopper tank. A handle connects to the vertical arm near the bottom end thereof. The handle is moveable to a plurality of positions between a first position in which the lid is in the vertical volume of the opening and a second position in which the lid is outside of the vertical volume of the opening.

In another form thereof the invention is a method of exposing the top opening in a bulk hopper tank wherein the lid covers the opening, the method comprising the steps of: lifting the lid vertically off of the opening; pivoting the lid away from the vertical volume of the opening; and lowering the lid.

BRIEF DESCRIPTION OF THE DRAWINGS

The following description very briefly describes the drawings which form a part of this patent application.

DETAILED DESCRIPTION OF A SPECIFIC EMBODIMENT

Figure 1:
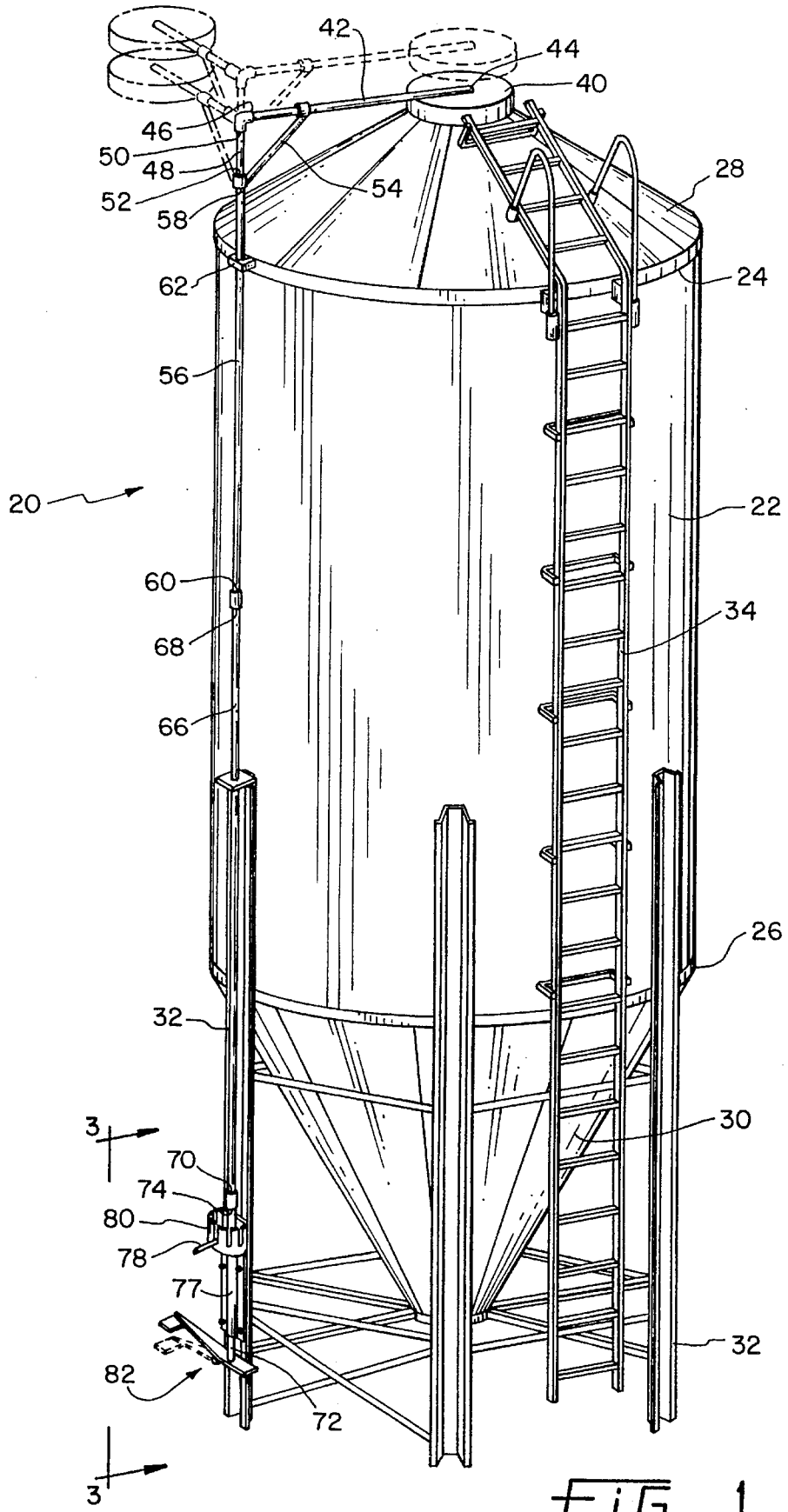
FIG. 1 is a perspective view of the bulk hopper tank wherein the lid is shown in a closed, an open and up position.
Figure 2:
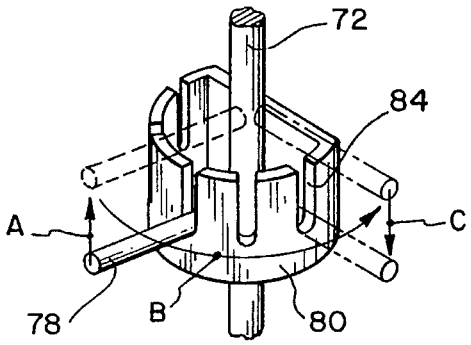
FIG. 2 is a perspective view of the handle assembly of the embodiment of FIG. 1 showing the various positions of the handle during operation which correspond to the various positions of the lid.

Referring to FIGS. 1 and 2, there is shown a bulk hopper tank generally designated as 20. Bulk hopper tank 20 has an elongate cylindrical mediate section 22 with opposite top 24 and bottom 26 ends. A frusto-conical section 28 connects to the top end 24 of the mediate section 22. There is a round opening in the top of the frusto-conical section 28. A funnel section 30 connects to the bottom end 26 of the mediate section 22. A plurality of vertical support members 32 connect to the side of the cylindrical mediate section 22 and descend downwardly to the ground. These vertical support members 32 support the bulk hopper tank. A ladder 34 extends from the top of the bulk hopper tank to the ground so as to provide manual access to the opening in the top of the bulk hopper tank.

A generally round lid 40 covers the round opening in the top of the bulk hopper tank, except when access to the bulk hopper tank through the top opening is necessary. When the lid 40 covers the opening, it does so in such a fashion so as to keep moisture and contaminants out of the bulk hopper tank. The lid 40 can be made of polyethylene, for example, so as to provide a flexibility that enhances the ability of the lid 40 to seal the opening.

A horizontal arm 42 has a distal end 44 which connects to the lid 40 and another end 46. A first vertical arm 48 has a top end 50 which connects to the other end 46 of the horizontal arm 42. The first vertical arm 48 has a bottom end 52. A brace member 54 spans between the horizontal arm 42 and the first vertical arm 48 to support and strengthen the same.

A second vertical arm 56 has a top end 58 which connects with the bottom end 52 of the first vertical arm 48. The second vertical arm 56 has a bottom end 60.

A third vertical arm 66 has a top end 68 which connects to the bottom end 60 of the second arm member 56. The third vertical arm 66 has a bottom end 70. The third vertical arm 72 passes through a tube 74. A handle 78 connects to the fourth vertical arm 72 near the bottom thereof.

A semi-circular bracket 80 fastens to one vertical support member 32 near the bottom thereof, but at a such a height that it is convenient for the operator to manipulate the handle 78. The bracket 80 further contains a plurality of vertically oriented slots 84 which receive and secure the handle 78 so that it cannot rotate.

A foot lift assembly 82 is near the bottom of the one vertical support member 32. The foot lift assembly 82 includes a foot pedal 88 which pivotally connects to the one vertical support member at a pivot point 90.

Figure 3:
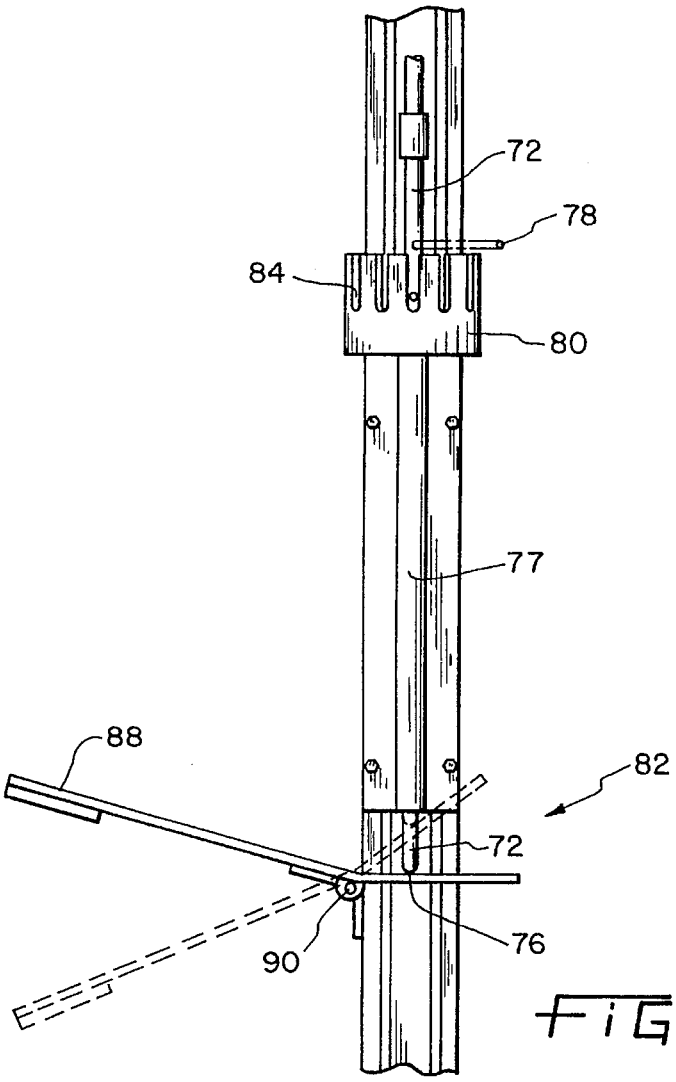
FIG. 3 is a side view of the lift assembly of the bulk hopper tank of FIG. 1 wherein the solid lines show the foot pedal in a position wherein the lid is down and the dashed lines show the foot pedal in a position where the lid is up.

Referring now to FIGS. 1 through 3, in operation, when the lid 40 covers the opening in the top of the bulk hopper tank, the lid protects the inside of the bulk hopper tank from the outside environment. This closed position is shown in FIG. 1 by the solid lines. However, on occasion, such as for filling the bulk hopper tank, it is necessary to provide access to the bulk hopper tank through the opening in the top thereof. Typically, a supply vehicle, such as, for example, a grain truck having an auger, carries particulate material, such as, for example, grain, which then fills the bulk hopper tank through the auger or other outflow type of apparatus. It is important that the auger have unimpeded access to the top opening, and in order to provide such access, the lid 40 must be clear of the opening. The present structure provides a way for this to occur.

The lid 40 may be moved by the operator on the ground from the closed to the open position by depressing the foot pedal to thereby lift the combination of the three vertical arms (48, 56, 66) which, in turn, raises the lid off of the opening. This position is shown by the dashed lines in FIG. 1. The position of the handle 78 is shown by dashed lines in FIG. 2. The lifting of the handle 78 is also shown by arrow A in FIG. 2. While this opens the opening, there is not sufficient room for the auger to access the bulk hopper tank without a potential for damage to the auger or the lid. Once the lid is in the up position (dashed lines in FIG. 1), the operator then rotates the combination of the four vertical arms via the handle 78 to the desired position away from the opening. The rotation of the handle 78 is shown by arrow B in FIG. 2. In FIG. 1, the position shown by the dotted lines, which represents a position well away from the opening.

The operator can now let up on the foot pedal so that the combination of the three vertical arms and the lid moves downwardly under its own weight. The downward movement of the handle 78 is shown by arrow C in FIG. 2. This position is shown by the broken lines FIG. 1. The handle 78 is within a slot 84 so as to restrict its ability to rotate, which, in turn, restricts the three vertical arms from rotation.

To close the opening once the necessity for access thereto is complete, the operator depresses the foot pedal to raise the vertical arms and lid 40. The operator then rotates the vertical arm and lid via the handle 78 to the original position. The operator then lets up on the foot pedal to allow the lid to cover the opening in the top of the bulk hopper tank.

It is apparent that applicant has invented a new and useful bulk hopper tank assembly that accomplishes the objectives of the invention as set forth in this patent application.

Other specific embodiments of the invention will be apparent to those skilled in the art from a consideration of this specification or practice of the invention disclosed herein. It is intended that the specification and specific embodiments be considered as exemplary only, with the true scope and spirit of the invention being indicated by the following claims.

What is claimed is:

1. A bulk hopper tank assembly comprising:

a bulk hopper tank having a top end and a bottom end, the bulk hopper tank containing an opening at the top end thereof, the bulk hopper tank having an exterior side;

a lid assembly, the lid assembly including:

a lid, a generally vertical arm extending along the exterior side of the bulk hopper tank, the vertical arm having opposite top and bottom ends, a generally horizontal arm having opposite ends wherein one end thereof being attached to the lid and the other end thereof being connected to the top end of the vertical arm, a lifter attached to the bottom end of the vertical arm, the lifter moveable between a down position and an up position, a handle being connected to the vertical arm near the bottom end thereof, when the lifter is in the up position the handle being moveable to a plurality of positions between a first position in which the lid is over the opening and a second position in which the lid is away from the opening so as to not cover any of the opening.

2. The bulk hopper tank assembly of claim 1 wherein the opening is round.

3. The bulk hopper tank assembly of claim 1 wherein when the handle is in the first position and the lifter is in the down position, the lid covers the opening.

4. The bulk hopper tank assembly of claim 1 further including a frusto-conical top section, the opening being at the center of the frusto-conical top section.

5. The bulk hopper tank assembly of claim 1 further including a bracket having a plurality slots, the handle being received in a selected one of the slots, and each slot corresponds to one of the plurality of positions of the handle.

6. The bulk hopper tank assembly of claim 5 wherein each slot is capable of engaging the handle so that the handle cannot be moved.

7. The bulk hopper assembly of claim 5 further including a plurality of support legs attached to the exterior side of the bulk hopper tank.

8. The bulk hopper assembly of claim 7 wherein the bracket is attached to a selected one of the support legs.

9. A lid assembly for a bulk hopper tank that has a top end with an opening therein and an exterior side, the lid assembly comprising:

a lid, a generally vertical arm extending along the exterior side of the bulk hopper tank, the vertical arm having opposite top and bottom ends, a generally horizontal arm having opposite ends wherein one end thereof being attached to the lid and the other end thereof being connected to the top end of the vertical arm, a lifter attached to the bottom end of the vertical arm, the lifter moveable between a down position and an up position, a handle being connected to the vertical arm near the bottom end thereof, when the lifter is in the up position the handle being moveable to a plurality of positions between a first position in which the lid is over the opening and second position in which the lid is away from the opening so as to not cover any of the opening.

10. The lid assembly of claim 9 wherein the opening is round.

11. The lid assembly of claim 9 further including a bracket having a plurality slots, the handle being received in a selected one of the slots, and each slot corresponds to one of the plurality of positions of the handle.

12. The lid assembly of claim 11 wherein each slot is capable of engaging the handle so that the handle cannot be moved.

13. A bulk hopper tank assembly comprising:

a bulk hopper tank having a top end and a bottom end, the bulk hopper tank having an exterior side, a plurality of support legs being attached to the exterior side of the bulk hopper tank, the bulk hopper tank having an opening near the top end thereof;

a lid assembly operatively connected to the bulk hopper tank, the lid assembly including:

a lid, a generally vertical arm extending along the exterior side of the bulk hopper tank, the vertical arm having opposite top and bottom ends, a generally horizontal arm having opposite ends wherein one end thereof being attached to the lid and the other end thereof being connected to the top end of the vertical arm, a lifter pivotally connected to one of the support legs, the lifter engaging the bottom end of the vertical arm, the lifter moveable between a down position and an up position;

a bracket attached to the one selected support leg, the bracket presenting a plurality of slots; and a handle being connected to the vertical arm near the bottom end thereof, when the lifter is in the down position the handle being received in a selected one of the slots so as to define one of a plurality of positions of the lid between and including a first position in which the lid is over the opening and a second position in which the lid is away from the opening so as to not cover any of the opening, and when the lifter is in the up position the handle being moveable to a selected one of the positions.

14. The bulk hopper assembly of claim 13 further including a generally frusto-conical top section being attached to the top end of the tank, the frusto-conical top section containing a central opening therein, and a funnel being attached to the bottom end of the bulk hopper tank.

15. The bulk hopper assembly of claim 14 wherein when the handle is in the second position the lid does not cover any of the frusto-conical top section of the bulk hopper tank.

* * * * *